US010413152B2

(12) United States Patent
Thiyagarajan

(10) Patent No.: US 10,413,152 B2
(45) Date of Patent: Sep. 17, 2019

(54) SPRAY ASSEMBLIES FOR DISHWASHER APPLIANCES

(71) Applicant: Haier US Appliance Solutions, Inc., Wilmington, DE (US)

(72) Inventor: Ramasamy Thiyagarajan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 386 days.

(21) Appl. No.: 15/298,514

(22) Filed: Oct. 20, 2016

(65) Prior Publication Data

US 2018/0110395 A1 Apr. 26, 2018

(51) Int. Cl.

| | |
|---|---|
| ***A47L 15/16*** | (2006.01) |
| ***A47L 15/20*** | (2006.01) |
| ***A47L 15/23*** | (2006.01) |
| ***A47L 15/42*** | (2006.01) |
| ***A47L 15/50*** | (2006.01) |

(52) U.S. Cl.

CPC ..... *A47L 15/428* (2013.01); *A47L 15/16* (2013.01); *A47L 15/20* (2013.01); *A47L 15/23* (2013.01); *A47L 15/4208* (2013.01); *A47L 15/4221* (2013.01); *A47L 15/4225* (2013.01); *A47L 15/4259* (2013.01); *A47L 15/4261* (2013.01); *A47L 15/502* (2013.01); *A47L 15/507* (2013.01)

(58) Field of Classification Search

CPC ..... A47L 15/16; A47L 15/20; A47L 15/23; A47L 15/4208; A47L 15/4221; A47L 15/4225; A47L 15/4259; A47L 15/4261; A47L 15/428; A47L 15/502; A47L 15/507

USPC ..... 134/56 D, 57 D, 58 D, 104.1

See application file for complete search history.

(56) References Cited

U.S. PATENT DOCUMENTS

| | | | |
|---|---|---|---|
| 9,241,607 B2 | 1/2016 | Porcaro, II et al. | |
| 2011/0030742 A1* | 2/2011 | Dalsing | A47L 15/16 134/198 |

FOREIGN PATENT DOCUMENTS

| | | |
|---|---|---|
| CN | 201505114 U | 6/2010 |
| JP | 9289963 A | 11/1997 |
| KR | 0143429 B1 | 7/1998 |

* cited by examiner

*Primary Examiner* — Levon J Shahinian

(74) *Attorney, Agent, or Firm* — Dority & Manning, P.A.

(57) ABSTRACT

A spray assembly for a dishwasher appliance is provided. The spray assembly is pivotally mounted over a wash rack and includes one or more spinning nozzles for directing a flow of wash fluid onto articles placed within the wash rack. The spinning nozzles are rotatably mounted to the spray assembly and include one or more vanes that harness the flow of wash fluid to rotate the spinning nozzle. The spinning nozzle has one or more discharge orifices that direct the flow of wash fluid onto articles in the wash chamber in a circular pattern as the spinning nozzle rotates, resulting in better spray coverage with fewer nozzles.

17 Claims, 8 Drawing Sheets

SPRAY ASSEMBLIES FOR DISHWASHER APPLIANCES

FIELD OF THE INVENTION

The present disclosure relates generally to dishwasher appliances, and more particularly to improved spray assemblies for dishwasher appliances.

BACKGROUND OF THE INVENTION

Dishwasher appliances generally include a tub that defines a wash chamber. Rack assemblies can be mounted within the wash chamber of the tub for receipt of articles for washing. During wash and rinse cycles, spray assemblies within the wash chamber can apply or direct wash fluid (e.g. various combinations of water and detergent along with optional additives) towards articles disposed within the rack assemblies in order to clean such articles.

To improve spray coverage, multiple spray assemblies can be provided including e.g., a lower spray arm assembly mounted to the tub at a bottom of the wash chamber, a mid-level spray arm assembly mounted to one of the rack assemblies, and/or an upper spray assembly mounted to the tub at a top of the wash chamber. Other configurations may be used as well.

One limitation of many currently known spray arm assemblies is the geometry of the spray arm assemblies and their fixed nozzle positions and orientations. For example, rotating spray arms typically have multiple nozzles positioned along a length of the spray arm. As the spray arm rotates, each nozzle emits wash fluid from a fixed location relative to the arm and in a fixed direction, generating a predictable and limited circular spray pattern having gaps in spray coverage. These limitations can result in articles not being properly cleaned during operation of the dishwasher appliance.

Spray coverage gaps can be decreased by using more nozzles or by shaping the nozzles as slots to generate a broader spray from each nozzle. However, such nozzle adjustments will result in decreased impingement force unless the hydraulic power is increased. Increasing the hydraulic power results in noisier operation and increased energy consumption. Moreover, increasing the number of nozzles or the spray coverage area of the nozzles increases overall energy and water consumption.

Accordingly, improved spray assemblies and associated dishwasher appliances are desired in the art. More specifically, improved spray assembly designs which increase the coverage of the wash fluid while reducing the noise and energy consumption of a dishwasher appliance would be particularly beneficial.

BRIEF DESCRIPTION OF THE INVENTION

The present subject matter provides a spray assembly for a dishwasher appliance. The spray assembly is pivotally mounted over a wash rack and includes one or more spinning nozzles for directing a flow of wash fluid onto articles placed within the wash rack. The spinning nozzles are rotatably mounted to the spray device assembly and include one or more vanes that harness the flow of wash fluid to rotate the spinning nozzle. The spinning nozzle has one or more discharge orifices that direct the flow of wash fluid onto articles in the wash chamber in a circular pattern as the spinning nozzle rotates, resulting in better spray coverage with fewer nozzles. The resulting spray assembly provides improved spray coverage, improved cleaning performance, and reduced water/energy usage compared to existing spray assemblies. Additional aspects and advantages of the invention will be set forth in part in the following description, may be apparent from the description, or may be learned through practice of the invention.

In accordance with one exemplary embodiment of the present disclosure, a dishwasher appliance defining a vertical, a lateral, and a transverse direction is provided. The dishwasher appliance includes a wash tub that defines a wash chamber; a wash rack mounted within the wash chamber, the wash rack being configured for receiving articles for washing; and a fluid circulation assembly for providing a flow of wash fluid for cleaning articles placed within the wash chamber. A spray assembly includes a spray device that is pivotally mounted to the wash tub and is configured for receiving the flow of wash fluid. The spray assembly includes a spinning nozzle rotatably mounted to the spray device and including a discharge orifice for directing the flow of wash fluid onto articles in the wash chamber. A vane is coupled to the spinning nozzle and is configured to rotate the spinning nozzle under a force from the flow of wash fluid.

In accordance with another exemplary embodiment of the present disclosure, a nozzle assembly for directing a flow of wash fluid from a spray device is provided. The nozzle assembly defines an axial direction and a radial direction. The nozzle assembly includes a spinning nozzle defining a first end and a second end separated along the axial direction. The spinning nozzle includes a discharge orifice positioned at the first end for discharging the flow of wash fluid. A sidewall defines an inlet at the second end of the spinning nozzle and a flow passageway placing the inlet in fluid communication with the discharge orifice. The sidewall further defines a venturi for drawing the flow of wash fluid through the inlet. A plurality of vanes extend from the sidewall of the spinning nozzle for harnessing a force of the flow of wash fluid to rotate the spinning nozzle.

According to still another embodiment of the present subject matter, a nozzle assembly for directing a flow of wash fluid from a spray device is provided. The nozzle assembly defines an axial direction and a radial direction. The nozzle assembly includes a circulation chamber defining a top and a bottom separated along the axial direction. A spinning nozzle is positioned within the circulation chamber and extends substantially between the top and the bottom of the circulation chamber along the axial direction, the spinning nozzle being rotatable about a central boss and defining a discharge orifice for discharging the flow of wash fluid. A vane extends from the central boss substantially along the radial direction, the vane being configured to rotate the spinning nozzle under a force from the flow of wash fluid, wherein the vane defines an aperture proximate the central boss.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
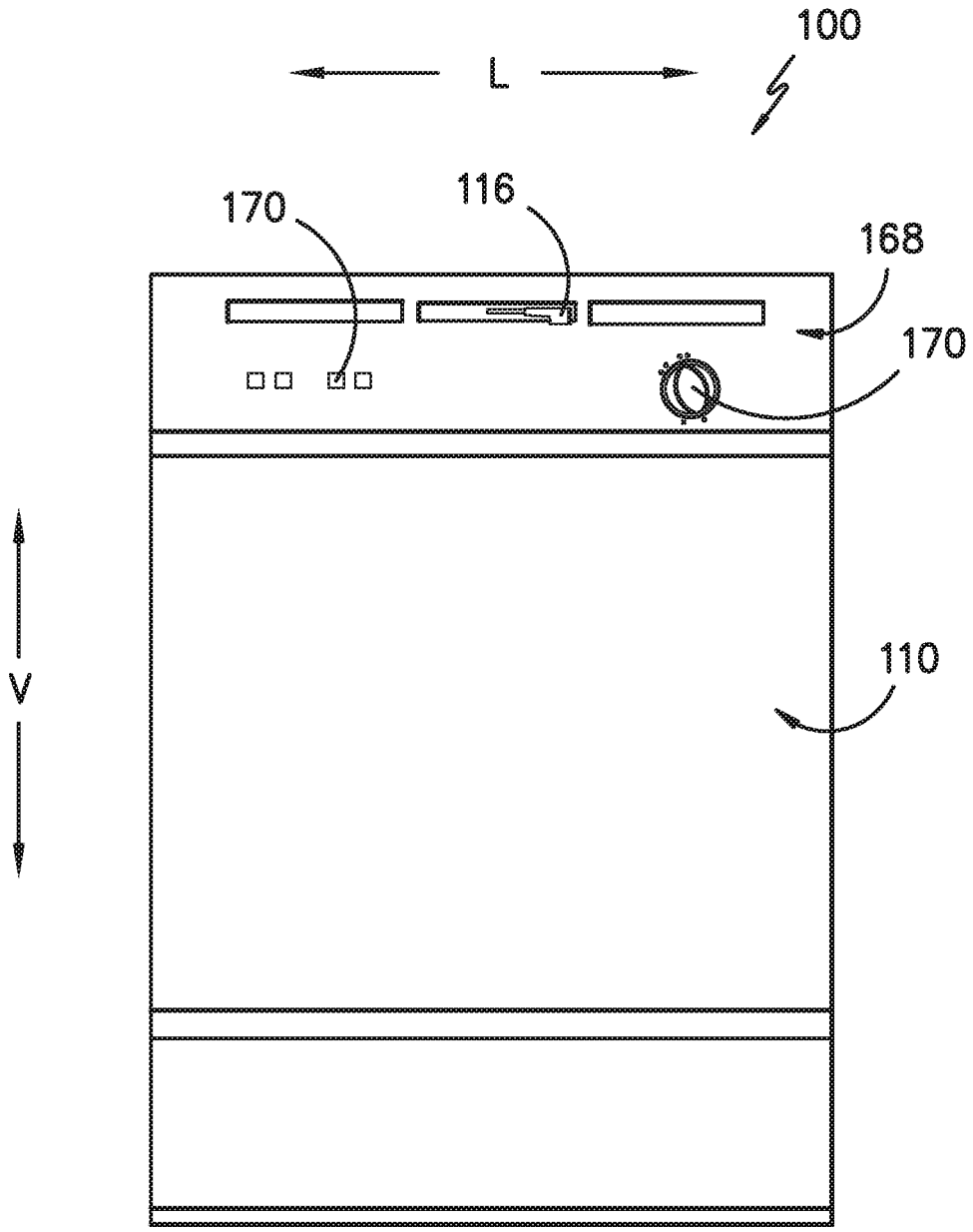
FIG. 1 provides a front view of an exemplary embodiment of a dishwashing appliance of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments. The use of the terms "top" and "bottom," or "upper" and "lower" herein are used for reference only as exemplary embodiments disclosed herein are not limited to the vertical orientation shown nor to any particular configuration shown; other constructions and orientations may also be used.

Figure 2:
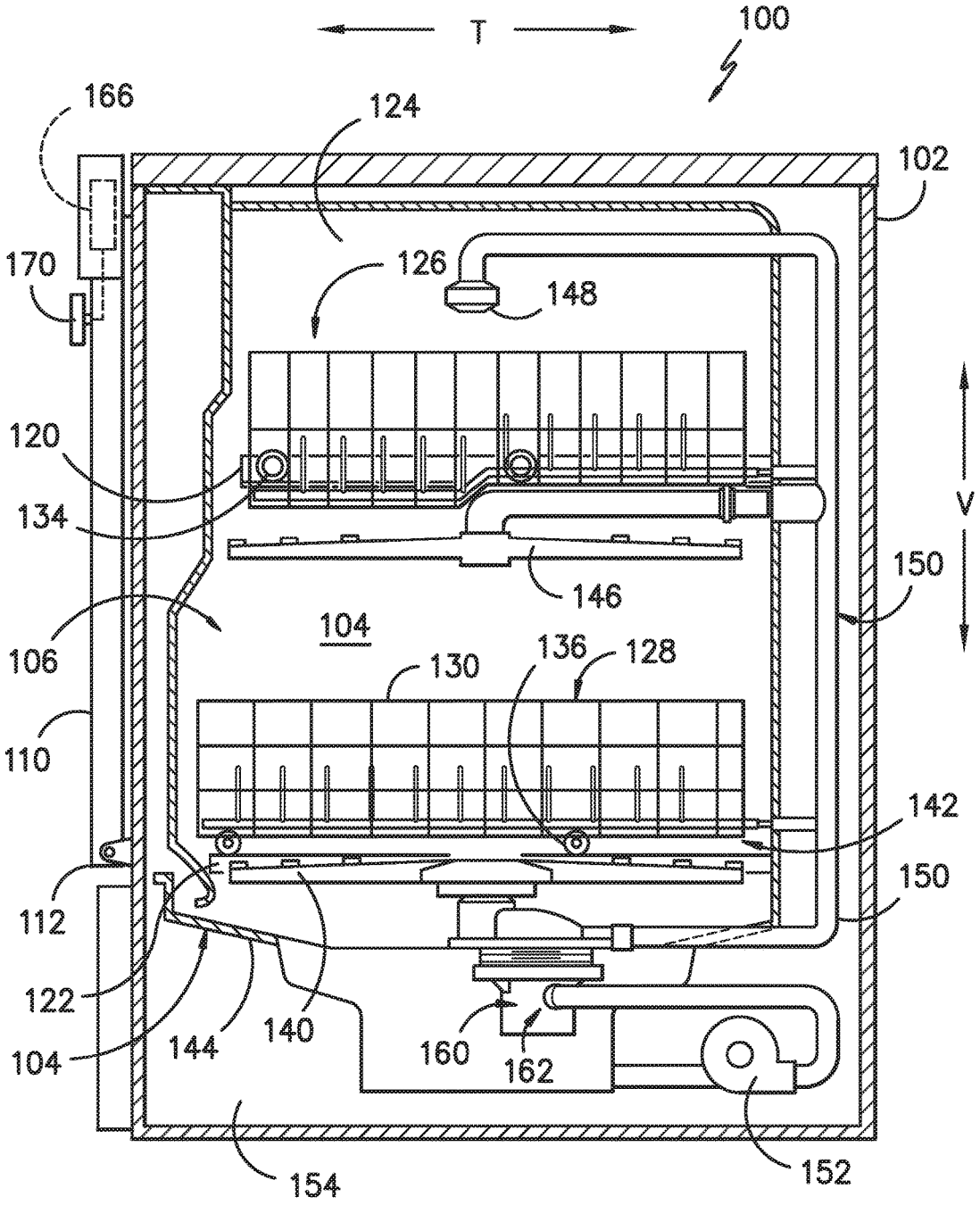
FIG. 2 provides a side cross sectional view of the exemplary dishwashing appliance of FIG. 1.

FIGS. 1 and 2 depict an exemplary domestic dishwasher 100 that may be configured in accordance with aspects of the present disclosure. For the particular embodiment of FIGS. 1 and 2, the dishwasher 100 includes a cabinet 102 having a tub or inner liner 104 therein that defines a wash chamber 106. As shown, tub 104 extends between a top and a bottom along a vertical direction V, between a first side and a second side along a lateral direction L, and between a front side and a rear side along a transverse direction T. Each of the vertical direction V, lateral direction L, and transverse direction T are mutually perpendicular to one another. The tub 104 includes a front opening (not shown) and a door 110 hinged at its bottom 112 for movement between a normally closed vertical position (shown in FIGS. 1 and 2), wherein the wash chamber 106 is sealed shut for washing operation, and a horizontal open position for loading and unloading of articles from the dishwasher 100. Latch 116 is used to lock and unlock door 110 for access to wash chamber 106.

Upper and lower guide rails 120, 122 are mounted on tub side walls 124 and accommodate roller-equipped rack assemblies 126 and 128. Each of the rack assemblies 126, 128 is fabricated into lattice structures including a plurality of elongated members 130 (for clarity of illustration, not all elongated members making up assemblies 126 and 128 are shown in FIG. 2). Each rack 126, 128 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 134 and 136, for example, mounted onto racks 126 and 128, respectively. A silverware basket 138 (FIG. 3) may be removably attached to rack assembly 128 for placement of silverware, utensils, and the like, that are otherwise too small to be accommodated by the racks 126, 128. Alternatively, silverware basket 138 may be independently mounted within wash chamber 106. It should be appreciated that upper rack assembly 126, lower rack assembly 128, and silverware basket 138 may be any suitable size and configuration and may be mounted within dishwasher 100 in any suitable manner.

The dishwasher 100 further includes a lower spray-arm assembly 140 that is rotatably mounted within a lower region 142 of the wash chamber 106 and above a tub sump portion 144 so as to rotate in relatively close proximity to rack assembly 128. A mid-level spray-arm assembly 146 is located in an upper region of the wash chamber 106 and may be located in close proximity to upper rack 126. Additionally, an upper spray assembly 148 may be located above the upper rack 126.

The lower and mid-level spray-arm assemblies 140, 146 and the upper spray assembly 148 are part of a fluid circulation assembly 150 for circulating water and dishwasher fluid in the tub 104. The fluid circulation assembly 150 also includes a pump 152 positioned in a machinery compartment 154 located below the tub sump portion 144 (i.e., bottom wall) of the tub 104, as generally recognized in the art. Pump 152 receives wash fluid from sump 144 and provides a flow of wash fluid to a diverter 160. The flow of wash fluid enters diverter 160 through an inlet 162, and diverter 160 directs the flow of wash fluid to one or more spray assemblies throughout the dishwasher, e.g., to spray assemblies 140, 146, and 148, or to a silverware spray assembly 200, as more fully described below.

Each spray-arm assembly 140, 146 includes an arrangement of discharge ports or orifices for directing washing liquid received from diverter 160 onto dishes or other articles located in rack assemblies 126 and 128. The arrangement of the discharge ports in spray-arm assemblies 140, 146 provides a rotational force by virtue of washing fluid flowing through the discharge ports. The resultant rotation of the spray-arm assemblies 140, 146 and the operation of spray assembly 148 using fluid from diverter 160 provides coverage of dishes and other dishwasher contents with a washing spray. Other configurations of spray assemblies may be used as well. For example, dishwasher 100 may have additional spray assemblies for cleaning silverware (e.g., spray assembly 200), for scouring casserole dishes, for spraying pots and pans, for cleaning bottles, etc. One skilled in the art will appreciate that the embodiments discussed herein are used for the purpose of explanation only, and are not limitations of the present subject matter.

The dishwasher 100 is further equipped with a controller 166 to regulate operation of the dishwasher 100. The controller 166 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 166 may be positioned in a variety of locations throughout dishwasher 100. In the illustrated embodiment, the controller 166 may be located within a control panel area 168 of door 110 as shown in FIGS. 1 and 2. In such an embodiment, input/output ("I/O") signals may be routed between the control system and various operational components of dishwasher 100 along wiring harnesses that may be routed through the bottom 112 of door 110. Typically, the controller 166 includes a user interface panel/controls 170 through which a user may select various operational features and modes and monitor progress of the dishwasher 100. In one embodiment, the user interface 170 may represent a general purpose I/O ("GPIO") device or functional block. In one embodiment, the user interface 170 may include input components, such as one or more of a variety of electrical, mechanical or electro-mechanical input devices including rotary dials, push buttons, and touch pads. The user interface 170 may include a display component, such as a digital or analog display device designed to provide operational feedback to a user. The user interface 170 may be in communication with the controller 166 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 170, different configurations may be provided for racks 126, 128, different spray arm assemblies 140, 146, 148 may be used, and other differences may be applied as well. Moreover, additional racks and/or spray assemblies in any suitable configuration may be included according to alternative embodiments.

Figure 3:
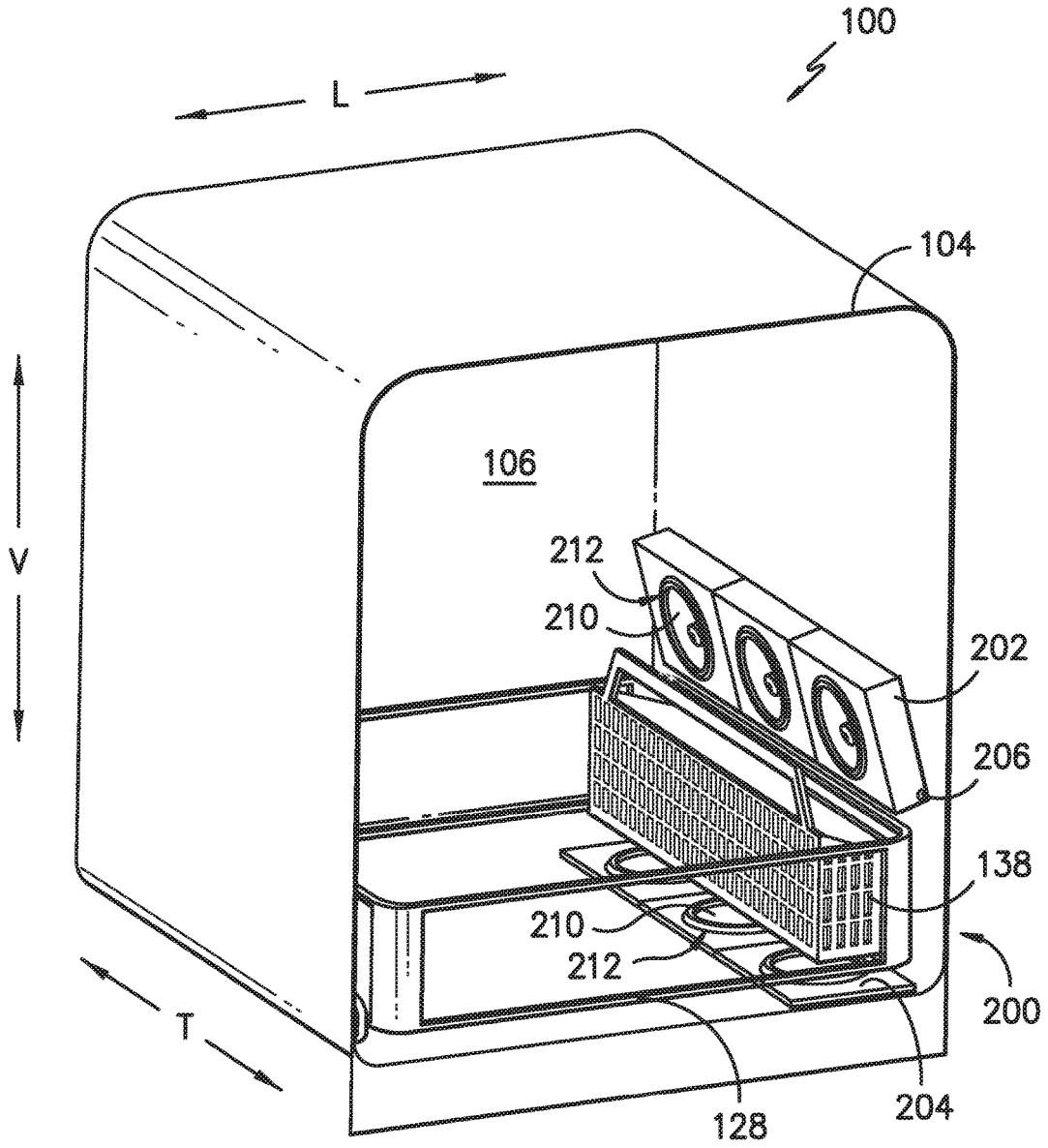
FIG. 3 is a perspective view of a spray assembly according to an exemplary embodiment of the present disclosure.
Figure 4:
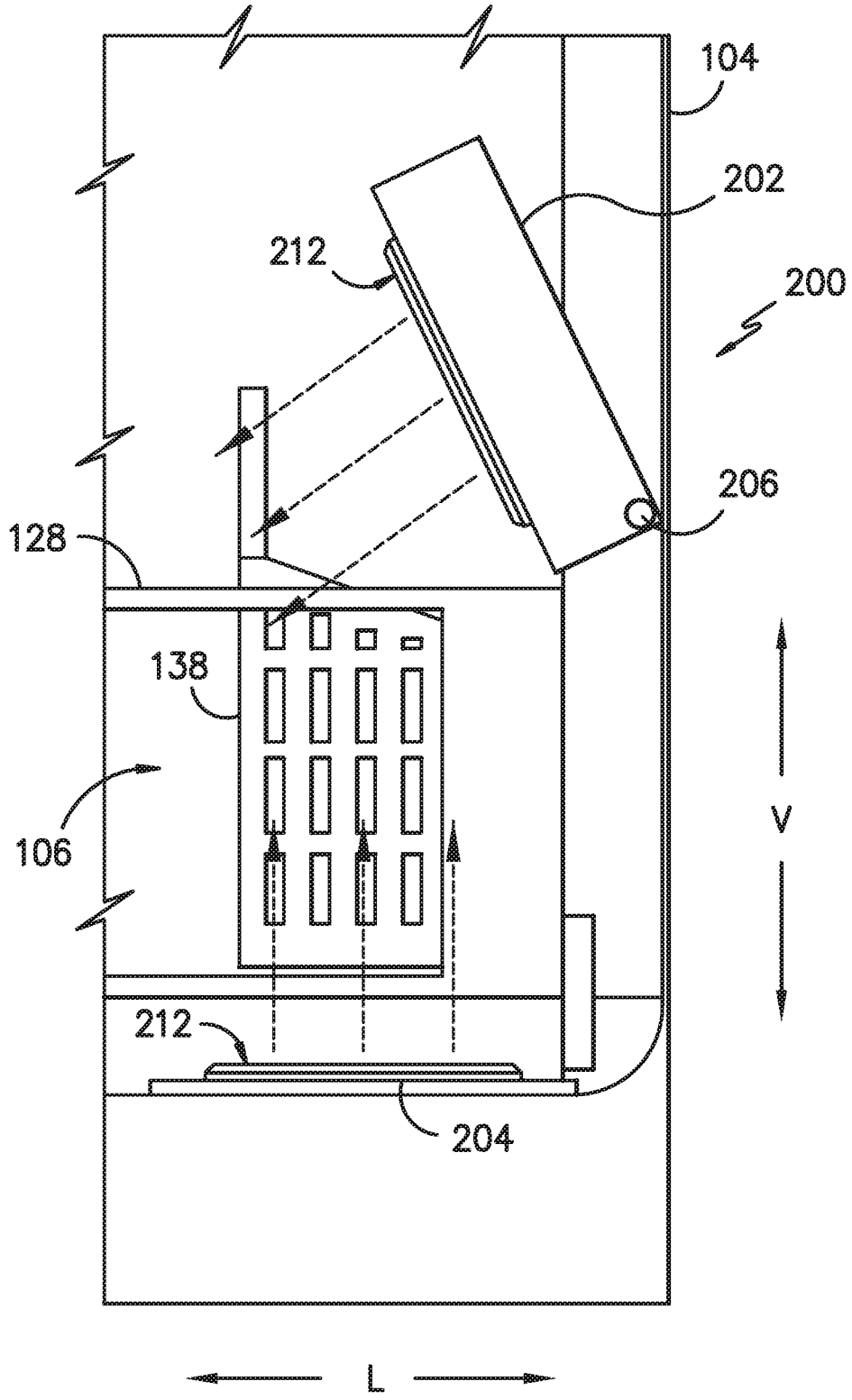
FIG. 4 is a front view of the exemplary spray assembly of FIG. 3.

Referring now to FIGS. 3 and 4, a perspective view of dishwasher 100 with a spray assembly 200 is illustrated. Door 110 has been removed and many details are not shown for clarity. As shown, silverware rack 138 is removably positioned in lower rack assembly 128. According to this exemplary embodiment, spray assembly 200 is configured primarily as a silverware spray assembly. However, as will be explained below, spray assembly 200 may also be configured for spraying articles outside silverware rack 138 according to alternative embodiments. In addition, spray assembly 200 may be positioned elsewhere within wash chamber 106 and may have a different size, shape, and configuration. For example, according to some embodiments, spray assembly 200 may be positioned and oriented such that it directs the flow of wash fluid downward along the vertical direction V to clean the water filter, e.g., by dislodging filtered particles from the mesh filter.

Spray assembly 200 includes an upper spray device 202 and a lower spray device 204. Upper spray device 202 and lower spray device 204 are in fluid communication with fluid circulation assembly 150 and are configured to receive and direct the flow of wash fluid onto articles positioned within wash chamber 106. Upper spray device 202 is mounted to a side of wash tub 104 above silverware basket 138 along the vertical direction V. In addition, upper spray device 202 is pivotally mounted such that it is rotatable about the transverse direction T about pivot point 206. In this regard, upper spray device 202 may pivot between a first position, e.g., where it is vertically oriented, and a second position, e.g., where it is horizontally oriented. In the first position, upper spray device 202 directs the flow of wash fluid into a center of wash chamber 106, and in the second position, upper spray device 202 directs the flow of wash fluid onto articles in silverware basket 138. Alternatively, upper spray device 202 may be pivoted in any suitable direction to direct the flow of wash fluid as desired.

As illustrated in FIGS. 3 and 4, lower spray device 204 is fixed into the bottom panel of wash tub 104. Lower spray device 204 is vertically oriented such that it directs the flow of wash fluid up into silverware basket 138. However, it should be appreciated that orientations of upper spray device 202 and lower spray device 204 illustrated herein are only used for the purpose of explaining aspects of the present subject matter. Other configurations are possible and within the scope of the present subject matter. For example, upper spray device 202 may be fixed and/or may be positioned adjacent silverware basket 138 along the lateral direction L.

Figure 5:
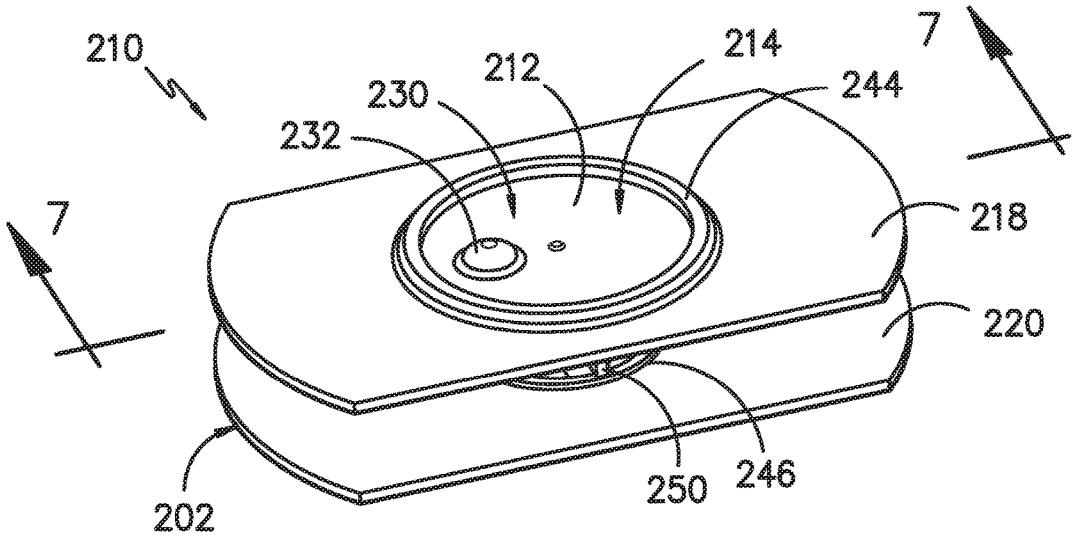
FIG. 5 is a perspective view of a nozzle assembly that may be used with the exemplary spray assembly of FIG. 3 according to an exemplary embodiment of the present subject matter.
Figure 6:
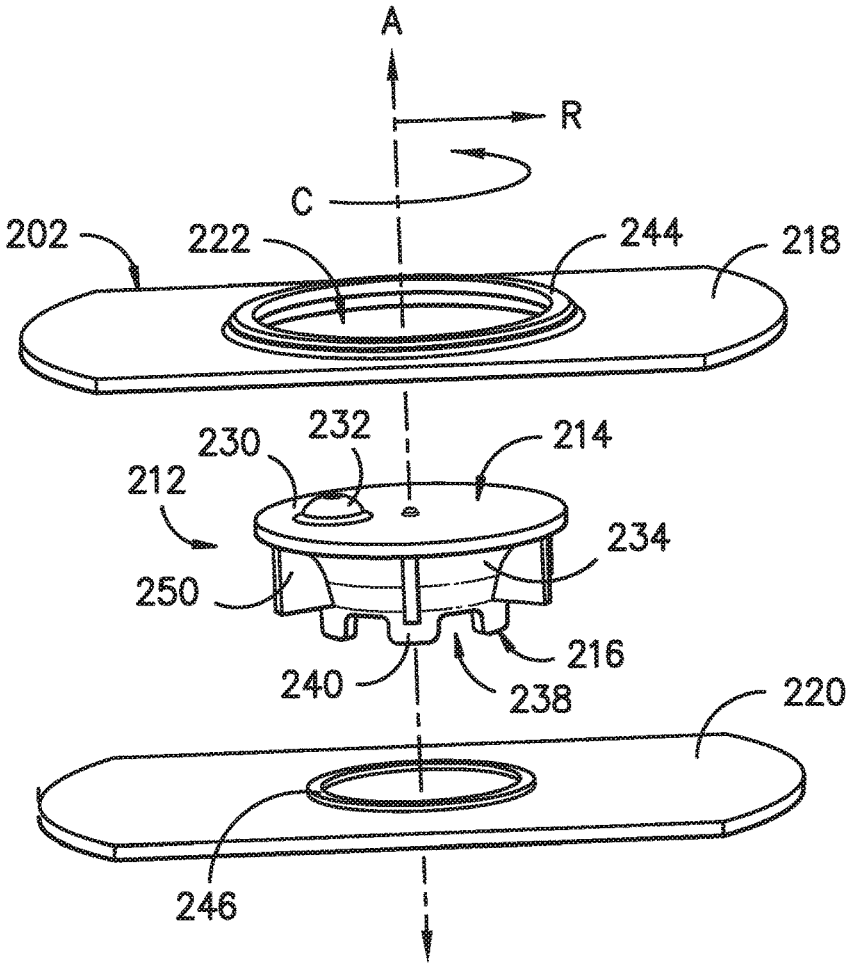
FIG. 6 is an exploded perspective view of the exemplary nozzle assembly of FIG. 5.
Figure 7:
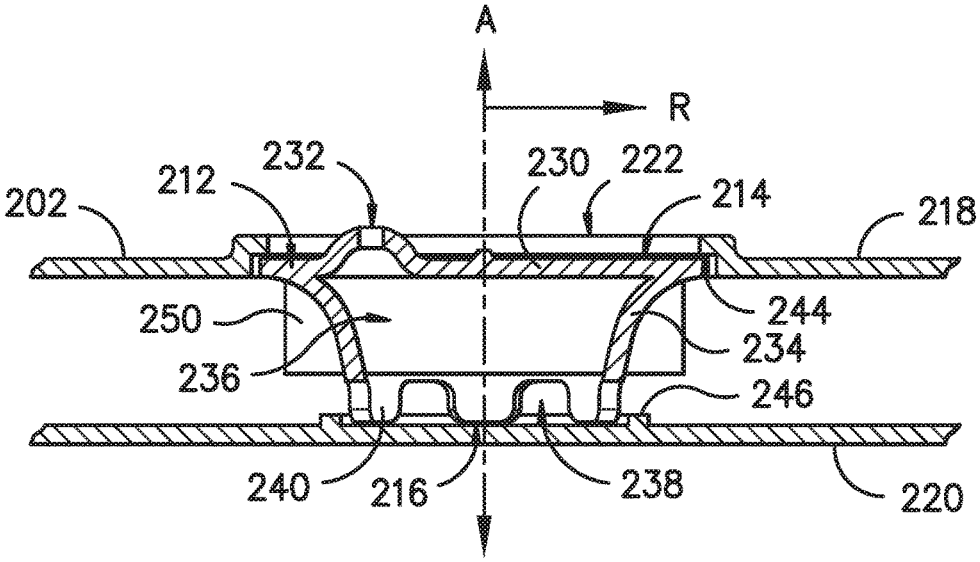
FIG. 7 is a side cross sectional view of the exemplary nozzle assembly of FIG. 5, taken along Line 7-7 of FIG. 5.

Referring now to FIGS. 5 through 7, an exemplary nozzle assembly 210 for use with spray assembly 200 will be described. More specifically, FIG. 5 provides a perspective view of nozzle assembly 210 positioned in a spray device, e.g., upper spray device 202. FIG. 6 provides an exploded view of nozzle assembly 210, and FIG. 7 provides a cross sectional view of nozzle assembly 210, taken along Line 7-7 of FIG. 5. Although described as being used in upper spray device 202, it should be appreciated that nozzle assembly 210 may be used in any spray arm, spray device, or fluid conduit. In addition, modifications and variations may be made to nozzle assembly 210 while remaining within the scope of the present subject matter. For example, according to the illustrated embodiment, upper spray device 202 and lower spray device 204 each include three nozzle assemblies 210 spaced apart along the transverse direction T. However, according to alternative embodiments, more or fewer than three nozzle assemblies 210 may be used and may be any suitable size or orientation.

Nozzle assembly 210 includes a spinning nozzle 212 that defines an axial direction A, a radial direction R, and a circumferential direction C. Spinning nozzle 212 defines a first end 214 and an opposite second end 216 separated along the axial direction A. Similarly, upper spray device 202 defines a top side 218 and a bottom side 220 which are separated along the axial direction A. Spinning nozzle 212 is positioned in upper spray device 202 such that first end 214 is positioned proximate top side 218 and second end 216 is positioned proximate bottom side 220. Top side 218 of upper spray device 202 defines an outlet 222, and spinning nozzle 212 is rotatably mounted within outlet 222 to discharge a flow of wash fluid from upper spray device 202 into wash chamber 106.

Spinning nozzle 212 includes a circular top face 230 at first end 214 that extends substantially along the radial direction R and is positioned in outlet 222. Top face 230 includes a discharge orifice 232 for directing the flow of wash fluid. According to the illustrated embodiment, discharge orifice 232 is integrally formed with top face 230 and is positioned off center on top face 230 such that it sprays in a small circular pattern as spinning nozzle 212 rotates about the axial direction A. Although illustrated as a single discharge orifice, it should be appreciated that spinning nozzle 212 may include more than one discharge orifice 232 positioned at any suitable location and oriented in any suitable direction. Moreover, discharge orifice 232 may be a separate component that is mounted in top face 230, and may be fixed or adjustable. Other configurations of discharge orifice 232 are possible. It should be appreciated, that as used herein, terms of approximation, such as "substantially," "about," or "approximately," refer to being within a 10% margin of error.

Spinning nozzle 212 further includes a sidewall 234 that extends between first end 214 and second end 216 and from top face 230 toward bottom side 220 of upper spray device 202. Sidewall 234 defines a flow passageway 236 oriented substantially along the axial direction A that places discharge orifice 232 in fluid communication with the flow of wash fluid within upper spray device 202. More specifically, sidewall 234 further defines an inlet 238 through which the flow of wash fluid may enter flow passageway 236 and travel to discharge orifice 232. According to the illustrated embodiment, inlet 238 is defined at a distal end of sidewall 234 relative to top face 230, e.g., proximate second end 216. In this regard, sidewall 234 defines a plurality of support feet 240 separated from each other along the circumferential direction C to define a plurality of openings which serve as inlet 238.

According to the illustrated embodiment, top side 218 of upper spray device 202 defines a recessed lip 244 surrounding outlet 222. Top face 230 of spinning nozzle 212 is positioned such that it is retained by and forms a seal with recessed lip 244. In this manner, discharge orifice 232 provides a passageway through which the flow of wash fluid may be ejected from upper spray device 202 into wash chamber 106 while unwanted leaks through outlet 222 may be reduced. In addition, bottom side 220 of upper spray device 202 defines a circular rib 246 that retains support feet 240 of spinning nozzle 212. In this manner, spinning nozzle 212 may rotate freely about the axial direction A while top face 230 maintains a seal with recessed lip 244. Such a fluid seal ensures that the pressure of the flow of wash fluid is maintained and the impingement force of the wash fluid directed from the discharge orifice 232 may be maximized.

As best illustrated in FIG. 7, sidewall 234 may have a venturi-shaped profile. In this regard, the cross sectional area defined by sidewall 234, as taken along a plane perpendicular to the axial direction A, increases as sidewall 234 extends from second end 216 to first end 214 of spinning nozzle 212. More specifically, flow passageway 236 defines a diverging cross section extending from inlet 238 toward discharge orifice 232 along the axial direction A. By defining a smaller cross sectional area proximate inlet 238 and a larger cross sectional area proximate discharge orifice 232, a relative pressure difference may be created by the Venturi effect. More specifically, as the flow of wash fluid passes through the diverging section of sidewall 234, the flow of wash fluid may increase in pressure and decrease in velocity. Therefore, the pressure of the flow of wash fluid is higher proximate discharge orifice 232 than at inlet 238, thus having a tendency to urge spinning nozzle 212 toward top side 218 of upper spray device 202 along the axial direction A. This increases the sealing force between top face 230 and recessed lip 244 and reduces the likelihood of leaks between spinning nozzle 212 and outlet 222.

Referring now specifically to FIG. 6, spinning nozzle 212 may further include one or more vanes 250. The term "vane," as used herein, may refer to any suitable member protruding from spinning nozzle 212 and being configured for capturing the momentum of the flow of wash fluid passing through upper spray device 202 for the purpose of rotating spinning nozzle 212. According to the illustrated embodiment, spinning nozzle 212 includes six vanes 250 that extend from sidewall 234 substantially along the radial direction R. However, it should be appreciated that any suitable number, size, and configuration of vanes may be used according to alternative embodiments.

As best shown in FIGS. 6 and 7, vanes 250 extend along the radial direction R but do not extend beyond top face 230 along the radial direction R. However, according to alternative embodiments, vanes may extend beyond top face along the radial direction R. In addition, vanes 250 extend from top face 230 along the axial direction A, but do not extend across the entire height of upper spray device 202. In this regard, vanes 250 stop above inlet 238 along the axial direction A such that they do not impede the flow of wash fluid entering inlet 238. However, according to alternative embodiments, vanes 250 may extend along the axial direction A all the way across an entire height of upper spray device 202 as defined between top side 218 and bottom side 220 of upper spray device 202.

Figure 8:
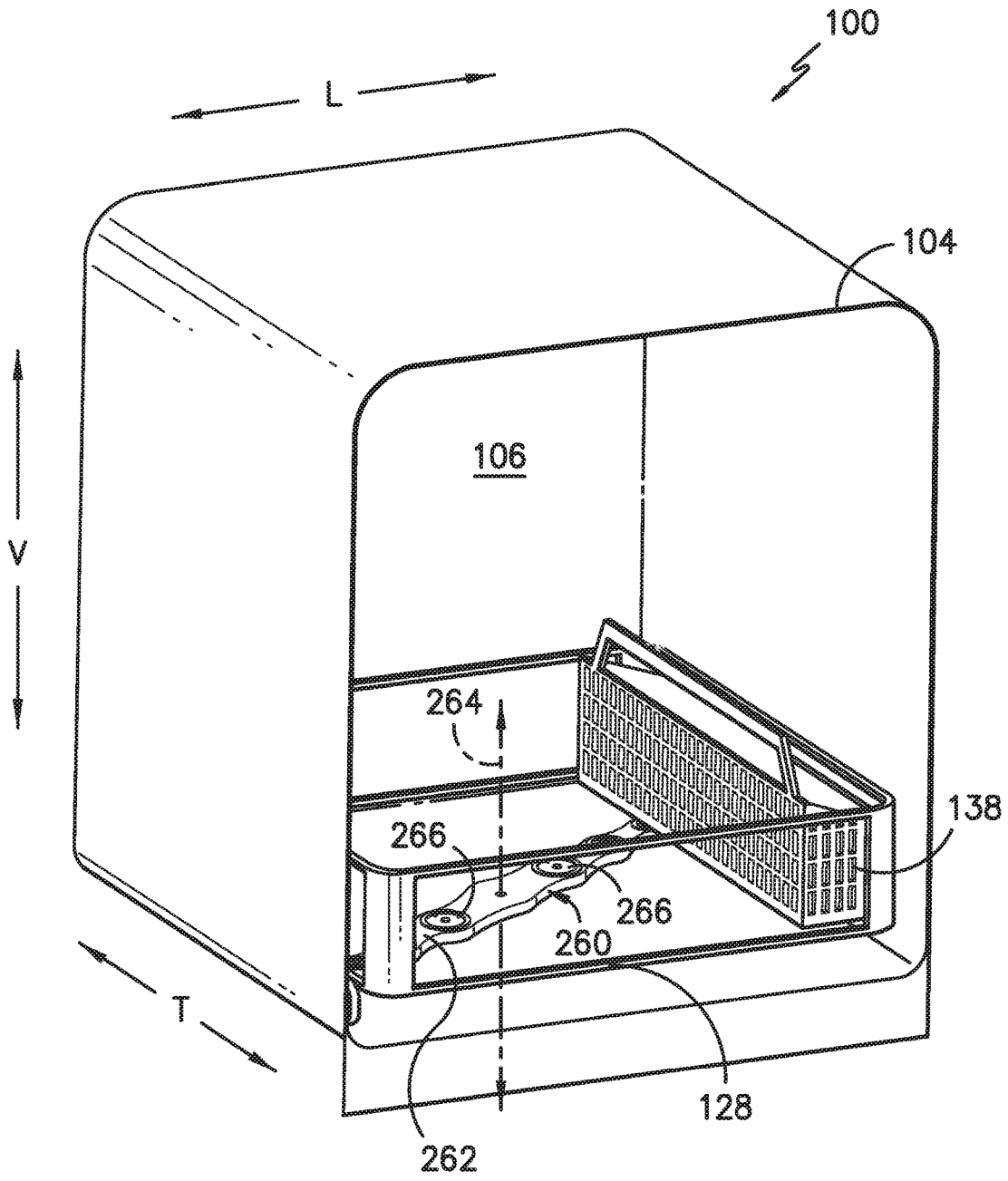
FIG. 8 is a front perspective view of a spray assembly according to another exemplary embodiment of the present disclosure.

Referring now to FIG. 8, a perspective view of dishwasher 100 with a spray assembly 260 is illustrated. Door 110 has been removed and many details are not shown for clarity. As shown, spray assembly 260 may be configured as lower spray assembly 140 from FIG. 2 and may be configured for cleaning articles placed in lower rack assembly 128. However, it should be appreciated, that aspects of the present disclosure may be applied to other spray assemblies as well. For example, spray assembly 260 may be configured as mid-level spray-arm assembly 146 or upper spray assembly 148 according to alternative embodiments. According to the exemplary embodiment, spray assembly 260 may be configured in substantially the same manner as spray assembly 200 depicted in FIGS. 3 through 7 and described above. Accordingly, the same or similar numbering may refer to the same or similar parts.

Spray assembly 260 includes a spray device 262 that is rotatable about a central axis 264 and includes multiple spinning nozzles 266. More specifically, six spinning nozzles 266 are spaced apart along a length of spray device 262. During operation, spray device 262 rotates while supplying a flow of wash fluid to each of the spinning nozzles 266. As discussed herein, spinning nozzles 266 rotate relative to spray device 262 such that more complete spray coverage of lower rack 128 may be achieved without including more nozzles, which could reduce the impingement velocity and cleaning power of the flow of wash fluid.

According to the illustrated embodiment, the diameter of spinning nozzles 266 is decreased as the nozzles move away from the central axis 264. However, according to alternative embodiments, spinning nozzles may be the same size or may be configured in any other suitable manner.

Figure 9:
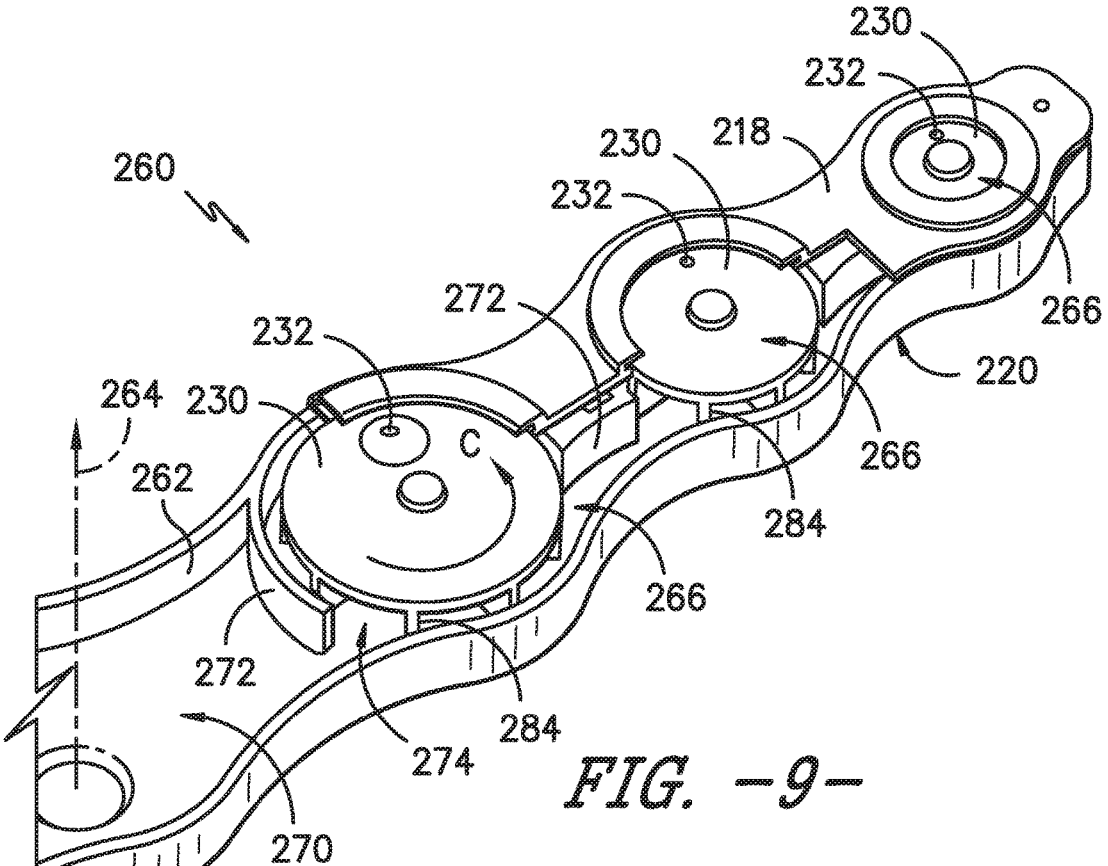
FIG. 9 is a partial perspective view of the exemplary spray assembly of FIG. 8 according to another exemplary embodiment of the present disclosure.
Figure 10:
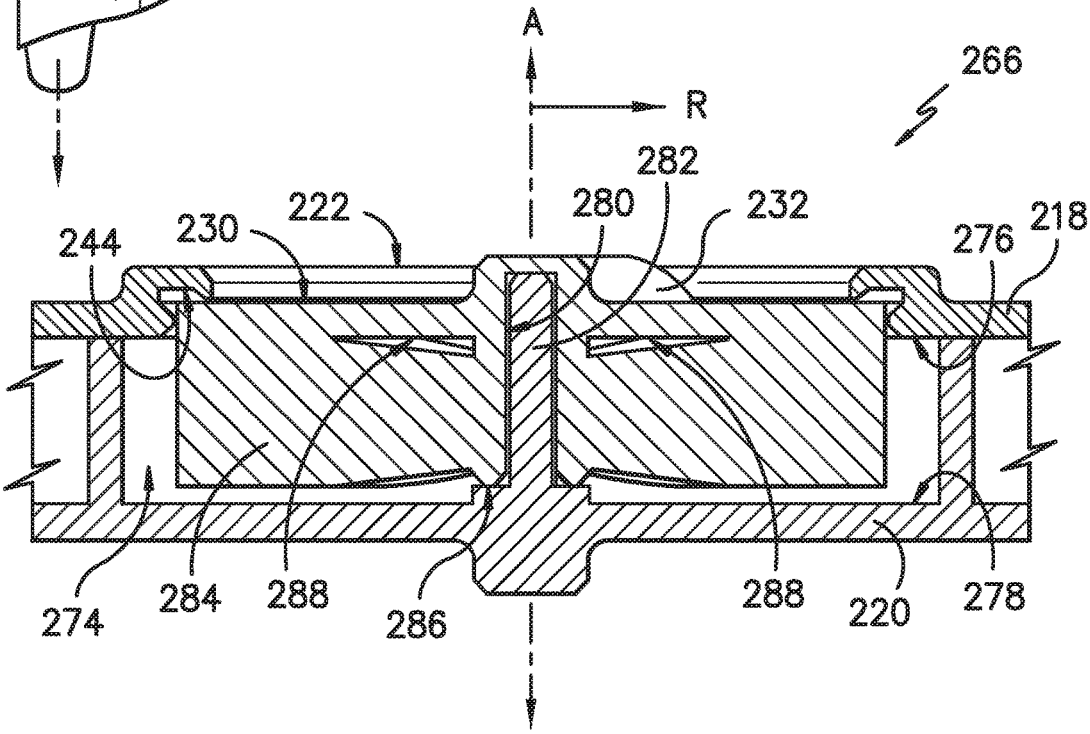
FIG. 10 is a side cross sectional view of a nozzle assembly that may be used with the exemplary spray assembly of FIG. 8.

FIGS. 9 and 10 provide partial perspective and cross sectional views of spray assembly 260. As illustrated, spray device 262 defines a fluid conduit 270 through which the flow of wash fluid may be supplied to spinning nozzles 266. In addition, spray assembly 260 may include a fluid guiding structure or wall, e.g., guide vane 272, that is configured to define a circulation chamber 274 and direct the flow of wash fluid to one side of spinning nozzle 266 to improve the conversion of fluid momentum into rotational force. Circulation chamber 274 defines a top 276 (adjacent top side 218 of spray device 262) and a bottom 278 (adjacent bottom side 220 of spray device 262) separated along the axial direction A. Circulation chamber 274 may also substantially enclose spinning nozzle 266, such that the flow of wash fluid may be guided or directed to interact with spinning nozzle 266.

Spinning nozzles 266 define an axial direction A, a radial direction R, and a circumferential direction C. Spinning nozzles 266 are positioned between a top side 218 and a bottom side 220 of spray device 262, which are separated along the axial direction A. More specifically, spinning nozzle 266 extends between top 276 and bottom 278 of circulation chamber 274 along the axial direction A such that spinning nozzle 266 interacts with the full flow of wash fluid. In this regard, top side 218 of upper spray device 202 defines an outlet 222, and spinning nozzle 266 is rotatably mounted adjacent outlet 222 to discharge a flow of wash fluid from spray device 262 into wash chamber 106.

Similar to the embodiment described above, spinning nozzle 266 includes a circular top face 230, is positioned in outlet 222, and includes a discharge orifice 232. According to the illustrated embodiment, top side 218 of spray device 262 defines a recessed lip 244 surrounding outlet 222. Top face 230 of spinning nozzle 266 is positioned such that it is retained by and forms a seal with recessed lip 244. Although described as being used in spray device 262, it should be appreciated that spinning nozzle 266 may be used in any spray arm, spray device, or fluid conduit. In addition, modifications and variations may be made to spinning nozzle while remaining within the scope of the present subject matter.

Referring now specifically to FIG. 10, spinning nozzle 266 further includes a central boss 280 that is rotatably mounted to a shaft 282 that extends from bottom side 220 of spray device 262 along the axial direction A. In this manner, spinning nozzle 266 may rotate freely about the axial direction A while top face 230 maintains a seal with recessed lip 244. As explained above, such a fluid seal ensures that the pressure of the flow of wash fluid and the impingement force of the wash fluid directed from the discharge orifice 232 may be maximized.

A plurality of vanes 284 extend from central boss 280 substantially along the radial direction R and act in a similar manner as vanes 250, e.g., by capturing the momentum of the flow of wash fluid passing through spray device 262 for the purpose of rotating spinning nozzle 266. As illustrated, vanes 284 extend from along the axial direction A along an entire height of spray device 262. More specifically, vanes 284 extend all the way from top side 218 to bottom side 220 of spray device 262. In addition, a low friction contact point 286 may be defined where central boss 280 and vanes 284 contact bottom side 220 of spray device 262, e.g., to reduce frictional losses as spinning nozzle 266 rotates within spray device 262.

Notably, because vanes 284 extend across the height of spray device 262 and break circulation chamber 274 into a plurality of independent segments, it is desirable to provide a path for fluid communication between the various segments defined by spinning nozzle 266. Accordingly, each of the plurality of vanes 284 defines an aperture 288 proximate central boss 280 and top side 218 of spray device 262, e.g., proximate top face 230. By positioning aperture on a radially inner portion of each vane 284, the ability of each vane 284 to harness the momentum from the flow of wash fluid is not limited. Moreover, by positioning aperture 288 proximate top side 218 of spray device 262, a continuous fluid passageway through each of vanes 284 may define an unimpeded path through which the pressurized flow of wash fluid may reach discharge orifice 232.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical, a lateral, and a transverse direction, the dishwasher appliance comprising:

a wash tub that defines a wash chamber;

a wash rack mounted within the wash chamber, the wash rack being configured for receiving articles for washing;

a fluid circulation assembly for providing a flow of wash fluid for cleaning articles placed within the wash chamber; and a spray assembly comprising:

a spray device pivotally mounted to the wash tub and being configured for receiving the flow of wash fluid;

a spinning nozzle rotatably mounted to the spray device and comprising a discharge orifice for directing the flow of wash fluid onto articles in the wash chamber the spinning nozzle further comprising a sidewall defining an inlet and a flow passageway placing the inlet in fluid communication with the discharge orifice, the sidewall defining a venturi for drawing the flow of wash fluid through the inlet; and a vane coupled to the spinning nozzle and being configured to rotate the spinning nozzle under a force from the flow of wash fluid.

2. The dishwasher appliance of claim 1, wherein the venturi is configured for creating a relatively high pressure region proximate the discharge orifice and a relatively low pressure region proximate the inlet.

3. The dishwasher appliance of claim 1, further comprising a plurality of vanes extending from the sidewall of the spinning nozzle for harnessing the force of the flow of wash fluid to rotate the spinning nozzle.

4. The dishwasher appliance of claim 1, wherein a top side of the spray device defines a circular recess and a bottom side of the spray device defines a circular rib for rotatably receiving and securing the spinning nozzle within the spray device.

5. The dishwasher appliance of claim 1, wherein the spray device defines a top and a bottom, the spinning nozzle comprising:

a central boss, the spinning nozzle being rotatable about the central boss; and a vane extending from the central boss substantially along the radial direction, the vane extending substantially between the top and the bottom of the spray device and being configured to rotate the spinning nozzle under a force from the flow of wash fluid, the vane defining an aperture proximate the central boss and the top of the spray device.

6. The dishwasher appliance of claim 5, wherein the spinning nozzle comprises a plurality of vanes extending substantially along a radial direction from the central boss.

7. The dishwasher appliance of claim 6, wherein each of the plurality of vanes defines an aperture proximate the central boss and the top of the spray device.

8. The dishwasher appliance of claim 1, wherein the spray assembly is positioned above the wash rack along the vertical direction, and wherein the spray device is pivotable between a first position and a second position about the transverse direction or the lateral direction, wherein the spinning nozzle directs the flow of wash fluid into a center of the wash chamber in the first position and into the wash rack in the second position.

9. The dishwasher appliance of claim 1, wherein the dishwasher appliance further comprises a lower spray assembly positioned below the wash rack, the lower spray assembly comprising:

a lower spray device mounted to the wash tub and being configured for receiving the flow of wash fluid;

a spinning nozzle rotatably mounted to the lower spray device and comprising a discharge orifice for directing the flow of wash fluid onto articles in the wash chamber; and a vane coupled to the spinning nozzle and being configured to rotate the spinning nozzle under the force from the flow of wash fluid.

10. The dishwasher appliance of claim 1, wherein the spinning nozzle is a first spinning nozzle and the spray assembly further comprises a second spinning nozzle, the first spinning nozzle and the second spinning nozzle being spaced apart along a length of the spray device.

11. The dishwasher appliance of claim 10, wherein the first spinning nozzle has a first diameter and the second spinning nozzle has a second diameter, the first diameter being larger than or equal to the second diameter.

12. The dishwasher appliance of claim 1, wherein the spinning nozzle is positioned on a bottom side of the spray device facing downward along the vertical direction, the spinning nozzle being configured for directing the flow of wash fluid toward a water filter to clean the water filter.

13. The dishwasher appliance of claim 1, wherein the spray assembly comprises a guide vane for directing the flow of wash fluid to one side of the spinning nozzle.

14. The dishwasher appliance of claim 1, wherein the spray device is rotatable about a central axis of the spray device.

15. The dishwasher appliance of claim 1, wherein the wash rack is a silverware basket.

16. A nozzle assembly for directing a flow of wash fluid from a spray device, the nozzle assembly defining an axial direction and a radial direction, the nozzle assembly comprising:

a spinning nozzle defining a first end and a second end separated along the axial direction, the spinning nozzle comprising a discharge orifice positioned at the first end for discharging the flow of wash fluid;

a sidewall defining an inlet at the second end of the spinning nozzle and a flow passageway placing the inlet in fluid communication with the discharge orifice, the sidewall defining a venturi for drawing the flow of wash fluid through the inlet; and a plurality of vanes extending from the sidewall of the spinning nozzle for harnessing a force of the flow of wash fluid to rotate the spinning nozzle.

17. The nozzle assembly of claim 16, wherein the venturi is configured for creating a relatively high pressure region proximate the discharge orifice and a relatively low pressure region proximate the inlet.

* * * * *